United States Patent [19]

Shulkin

[11] 3,982,303

[45] Sept. 28, 1976

[54] CORSAGE HOLDER

[76] Inventor: Robert A. Shulkin, E. 24122 Sprague, Liberty Lake, Wash. 99012

[22] Filed: Apr. 23, 1975

[21] Appl. No.: 570,559

[52] U.S. Cl. ..... 24/6
[51] Int. Cl.[2] ..... A45F 5/08
[58] Field of Search ..... 24/5, 6, 3 A, 12, 13

[56] References Cited

UNITED STATES PATENTS

| | | | |
|---|---|---|---|
| 520,650 | 5/1894 | Mente | 24/6 |
| 1,205,537 | 11/1916 | Hilpert | 24/6 |
| 1,344,821 | 6/1920 | Rhodes | 24/13 |
| 1,732,213 | 10/1929 | Alland | 24/6 |
| 1,816,714 | 7/1931 | Adler | 24/6 |
| 1,964,758 | 7/1934 | Guerin | 24/13 |
| 2,401,556 | 6/1946 | Di Stiso | 24/13 |
| 3,073,063 | 1/1963 | Schumm | 24/5 |
| 3,416,195 | 12/1968 | Borthwick | 24/5 |
| 3,627,182 | 12/1971 | Calkins | 24/3 A |
| 3,735,447 | 5/1973 | Abraham | 24/6 |

FOREIGN PATENTS OR APPLICATIONS

| | | | |
|---|---|---|---|
| 4,134 | 2/1906 | United Kingdom | 24/12 |

*Primary Examiner*—Donald A. Griffin
*Attorney, Agent, or Firm*—Wells, St. John & Roberts

[57] ABSTRACT

A corsage holder embodied in a solid elongated plastic molding includes a first longitudinal side adapted to be fitted against the stems of flowers arranged in a corsage. An opposite side of the molding receives tape ordinarily utilized to bind the stems together. At either end of the holder body is a transverse aperture for receiving a corsage pin. The holder is tapered along its length to conform to the natural taper of the tied stems of a corsage. The apertures are formed through projections which locate the apertures outward from the tape receiving surface of the holder body. When taped to the stems of a corsage, the projections are located outward from the taped stems and allow access to the apertures to facilitate pinning of the corsage to clothing.

5 Claims, 8 Drawing Figures

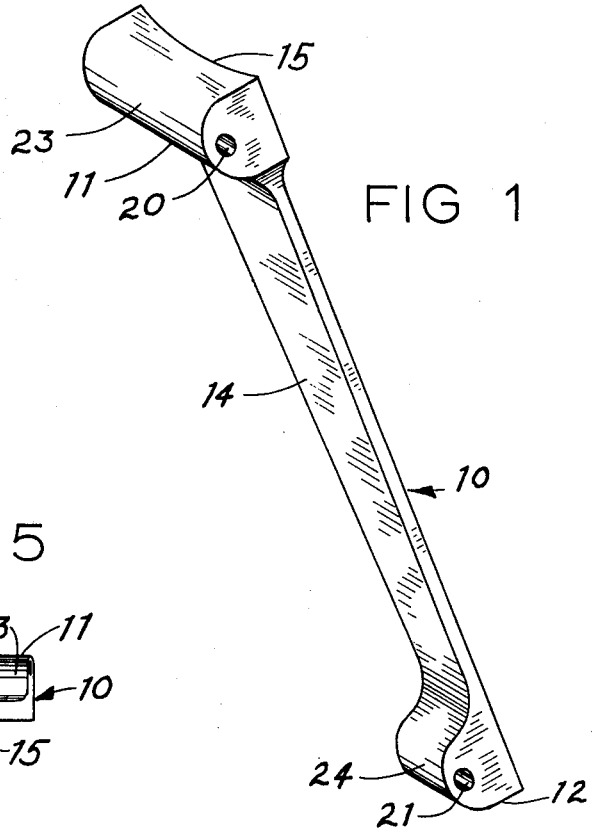
FIG 1
FIG 5
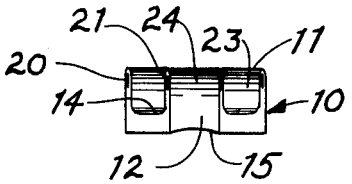
FIG 2
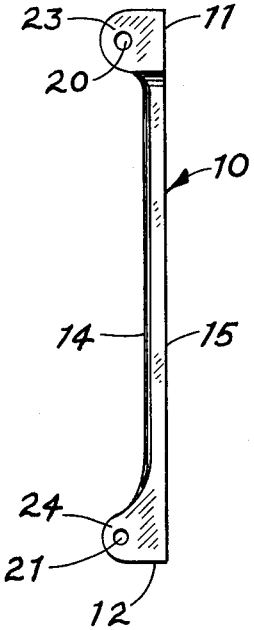
FIG 3
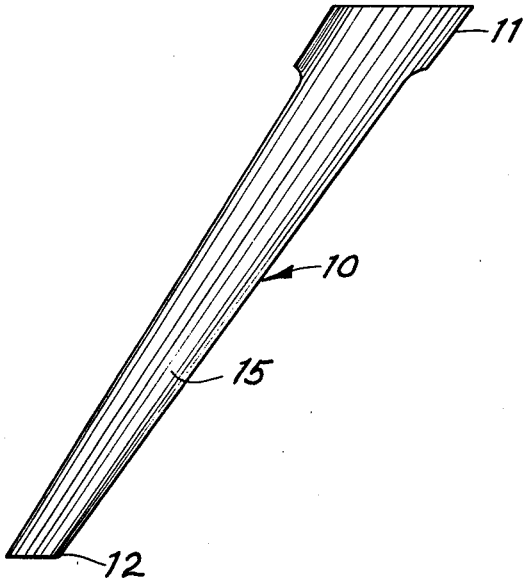
FIG 4
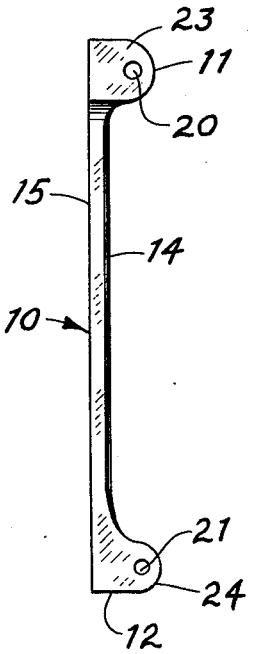

FIG 8
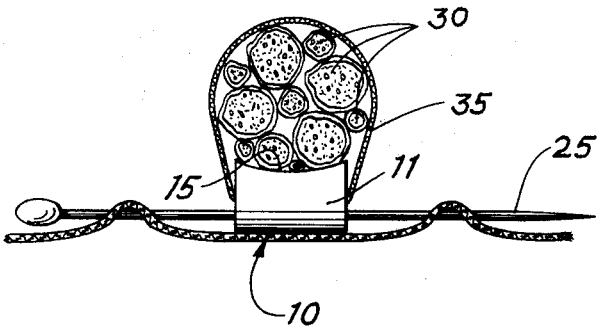
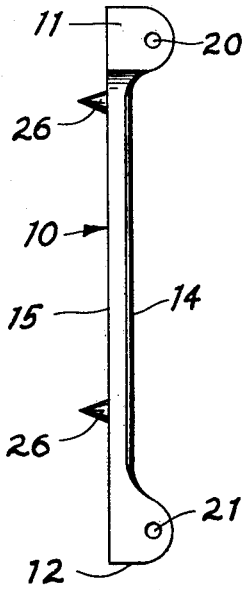
FIG 6
FIG 7
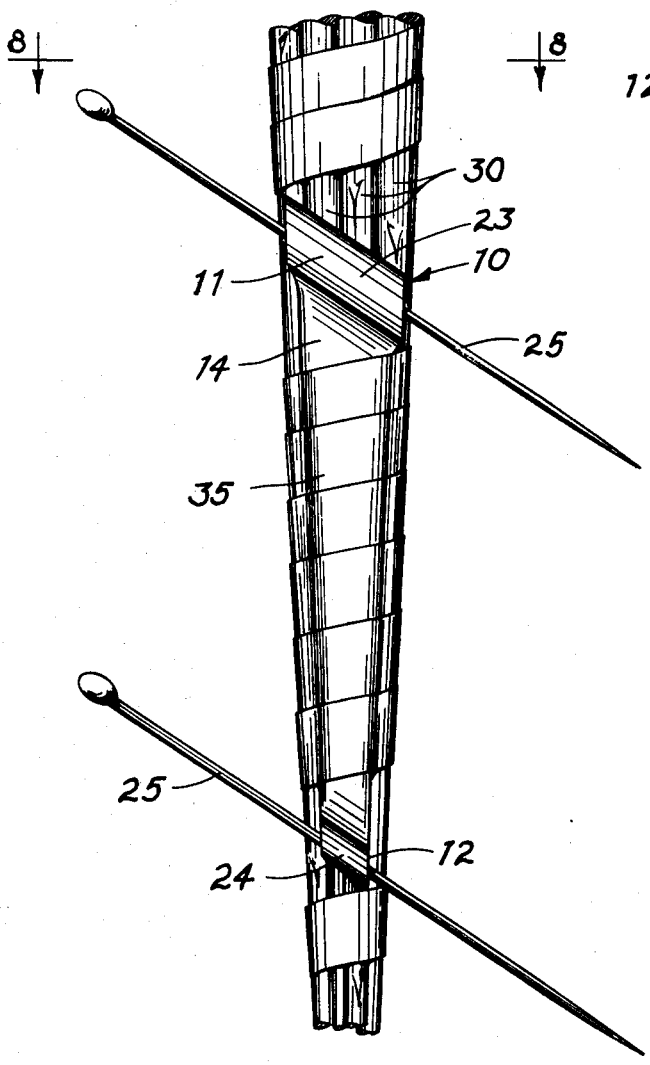

CORSAGE HOLDER

BACKGROUND OF THE INVENTION

The present invention is related to corsage holding devices and more particularly to such devices to facilitate pinning of the corsage to clothing.

Almost everyone has experienced some difficulty in pinning a corsage to a person's clothing. The difficulty arises from a confusing combination of flower stems, wire wrapping and tape. The sheer bulk of this arrangement makes it difficult to penetrate the corsage stem with the straight pins usually provided. Too often the person is penetrated by the pin also. It is therefore desirable to obtain some inexpensive device to make the pinning of a corsage onto the clothing of a person an easier task without endangering either the person pinning the corsage or the person on whom it is being pinned.

The above problem was recognized to some degree by U.S. Pat. No. 3,735,447 which discloses a holder and fastener for flowers and corsages comprised of two independent members. A first member is connectable to the stems of a corsage or flower and the remaining member is positionable at the inside surface of a garment. The two are secured by pins projecting through the garment. The pins are of substantial size and could damage the garment fabric. Use is also restricted by fabric thickness.

U.S. Pat. No. 1,205,537 discloses an open flower holder. This flower holder is made of foldable paper or other flexible material that may be formed into an upwardly open cup. A spaced pair of slots are formed through the material near the upwardly open end of the container to receive the shank of a safety pin. No obvious advantage is gained by providing such a container and pin arrangement to ease the task of pinning the corsage.

A similar receptacle is shown in U.S. Pat. No. 1,678,810. In this patent, a solid receptacle is disclosed, having a longitudinal recess for receiving water and the stems of flowers. A downwardly protruding pin is also included with the receptacle to permit attachment of the receptacle to a wearer's clothing. Again, no means is provided to receive a separate pin nor is the task of pinning the receptacle to clothing eased in any manner.

A different approach is disclosed in U.S. Pat. No. 3,416,195 which discloses two separate magnets for holding a corsage to a wearer's clothing. One magnet is attached to the stem of a corsage, while the other magnet is positioned at the inside surface of the fabric to magnetically hold the corsage on the wearer's clothing. Although this is a simple and painless device for applying and holding a corsage to a wearer's clothing, it is relatively expensive and might therefore unreasonably elevate the cost of the corsage. Also, fabric thickness may reduce the gripping force of the magnets.

The present invention is embodied in a corsage holder that may be made simply by molding a single body of plastic. The holder is therefore very inexpensive for a florist to supply with each corsage. The device includes an elongated body that may be taped along with the flower stems. Outwardly projecting portions at the ends of the holder body include transverse inclined apertures for loosely receiving corsage pins normally supplied by the florist. The apertures are located outward from the corsage stem in order to enable the wearer or some other person to easily insert a pin through a fabric fold, then through the aperture, and then through another fabric fold on the other side of the holder. One or two pins will then securely fasten the holder and attached corsage to the wearer's clothing.

SUMMARY OF THE INVENTION

A corsage holder is described comprising a solid elongated body having a stem receiving surface along one longitudinal side and a tape receiving surface along an opposite longitudinal side. Opposed longitudinal side edges join the stem and tape receiving surfaces. An open transverse aperture is formed through the body and extends from one side edge to the remaining side edge. The aperture is adapted to receive a corsage pin therein.

It is a first object of the present invention to provide a corsage holder that makes pinning of the corsage of flowers to a wearer's clothing an easier and less dangerous task.

A further object is to provide such a holder that is extremely simple in construction. It is preferably formed of a single solid element to hold manufacturing costs at a minimum.

It is still a further object to provide such a corsage holder that may be included within the corsage as the florist is arranging and gathering the flower stems to form the corsage body.

It is an additional object to provide such a corsage holder that is not affected by fabric thickness.

It is a further object to provide such a holder that enables the corsage to be securely pinned to the wearer's clothing without damaging the clothing fabric.

Another object is to provide such a holder that may be formed in varying sizes to accommodate different sized corsages.

These and still further objects and advantages will become apparent upon reading the following description which, taken with the accompanying drawings, disclose a preferred form of the present invention.

BRIEF DESCRIPTION OF THE DRAWINGS

FIG. 1 is a frontal pictorial view of the holder;

FIG. 2 is a right side view as seen from the right in FIG. 1;

FIG. 3 is a rear view of the holder;

FIG. 4 is a left side view;

FIG. 5 is a bottom end view as seen from below in FIG. 1;

FIG. 6 is a side view showing the holder with projections on a stem receiving side thereof;

FIG. 7 is a schematic view showing the holder attached to the stems of a corsage; and FIG. 8 is a sectional view taken substantially along line 7-7 in FIG. 7 showing the holder and corsage stems mounted by a pin to fabric.

DETAILED DESCRIPTION OF A PREFERRED EMBODIMENT

Looking to the drawings in more detail and especially to FIG. 1, a preferred form of the present invention is indicated by the reference character 10. The corsage holder includes a rigid body formed of a synthetic material or resin. It may be constructed by injecting molding. The body 10 basically includes an enlarged end 11 spaced longitudinally along a tapering medial portion from a reduced end 12. The body further includes a tape receiving side 14 and an opposed concave stem receiving side 15. When utilized, the side 15 is concave to conform to and partially encircle a bunched number of flower stems included with a corsage. Tape is then wound about both the stems and the body 10 with the tape being wrapped tightly along the length of the tape receiving side 14.

The body 10 further includes a pair of longitudinally spaced apertures 20 and 21. Aperture 20 is formed through the enlarged end 11. Aperture 21 is formed through the reduced end 12. Apertures 20 and 21 are formed through projections 23, 24 respectively. It is the purpose of projections 23, 24 to locate the apertures 20, 21 outwardly from the tape receiving surface 14. This in turn locates the apertures outward from the taped stems and medial body portion of the holder 10. As shown in FIG. 6, a pair of pointed projections 26 may be provided on the stem receiving surface 15 to firmly anchor the body 10 to an associated bundle of flower stems as shown by FIG. 7.

As may be noted in FIGS. 1 and 6, the apertures 20 and 21 are parallel and inclined diagonally with respect to the longitudinal sides of the body 10. The inclination of apertures 20 and 21 is designed so the corsage pins 25 may be held thereby at an optimum weight supporting angle with regard to the wearer's clothing and weight of the corsage. The inclined apertures also enable the length of pins 25 to be hidden beneath the corsage. Further, the inclined apertures 20 and 21 may be utilized to prevent the pins from working loose of the clothing and corsage.

During construction of the corsage, the florist may either wrap the body 10 with tape 35 along with bundled flower stems 30, or he may individually wrap the flower stems prior to mounting the holder. Holding the stem receiving side 15 against the gathered stems and embedding the projections 26 in the stems with the tape receiving side 14 facing outwardly, the florist wraps tape 35 about both the gathered flower stems and the corsage holder body 10 leaving only the projections 23 and 24 uncovered. The projections 23, 24 locate the apertures 20 and 21 outward from the gathered stems 30 to permit free passage of corsage pins 25 therethrough.

To attach the corsage, the wearer or other person may first insert the pin 25 through a fold of fabric and then pass the pin shank through the appropriate aperture 20 or 21. Once the pin shank is through aperture 20 or 21, a second fold of fabric may again be skewered on the pinpoint to securely fasten the holder and attached corsage to the wearer's clothing. The relativley free passage of the pin through the apertures and the positioning of the apertures away from the corsage stems alleviates the previous problems associated with the procedure of pinning the corsage to a wearer's clothing.

It is not always necessary that both apertures 20 and 21 be utilized for every pinning purpose. It is well understood that only a single aperture may be required with some smaller corsages. However, when a large and rather heavy corsage is to be fastened to a wearer's clothing, it is advisable to use two separate pins along with both apertures 20 and 21 of the holder 10 to firmly secure the corsage to the wearer's clothing and to minimize the chance of damage to the wearer's clothing due to the corsage weight transmitted through the pins.

It is to be understood that the above description was given by way of example only and that only the following claims are to be taken as definitions of this invention.

What I claim is:

1. A corsage holder, comprising:

a solid elongated body;

a stem receiving surface formed along one longitudinal side of said body adapted to be fitted against the gathered stems of flowers arranged in a corsage;

a tape receiving surface on the longitudinal side of said body opposite to said one longitudinal side; the tape receiving surface being adapted to be engaged by tape wrapped about the body and stems during construction of the corsage;

opposed longitudinal side edges joining the stem and tape receiving surfaces;

an open transverse aperture formed through the body, extending in open communication from one side edge to the other, the aperture being adapted to receive a corsage pin for fixing of the corsage to the clothing; said aperture beind inclined diagonally across the longitudinal sides of the body.

2. The corsage holder defined by claim 1 wherein the aperture is located at an upper end of the body and wherein an additional open aperture is formed transversely through the body from one side edge to the other and spaced along the length of the body from the remaining aperture.

3. The corsage holder defined by claim 1 wherein the stem receiving surface is longitudinally concave to conform to the gathered stems of a corsage and said side edges converge along the length of the body from an enlarged body end to a reduced body end and wherein said aperture is located at said enlarged body end.

4. The corsage holder defined by claim 3 wherein the enlarged body end includes a transverse projection extending outwardly from said tape receiving surface and wherein said aperture is formed through said projection outward of said tape receiving surface.

5. The corsage holder defined by claim 1 further comprising longitudinally spaced pointed projections extending outwardly from the stem receiving surface to facilitate anchoring of the body to the stem portion of a corsage.

* * * * *